United States Patent [19]

Murphy et al.

[11] 4,399,645

[45] Aug. 23, 1983

[54] BLADDER INSULATION

[75] Inventors: Paul D. Murphy, Frankfort; Clinton A. Reph, Amherst, both of Ohio

[73] Assignees: Lou Weitz; Jeriline Ward, both of Shaker Hts.; Joy Murphy, Bowling Green, all of Ohio ; part interest to each

[21] Appl. No.: 216,320

[22] Filed: Dec. 15, 1980

[51] Int. Cl.[3] ..... E04G 9/10; E04B 1/62; E04G 23/00

[52] U.S. Cl. ..... 52/743; 52/2; 52/406

[58] Field of Search ..... 52/743, 406, 2; 428/12, 428/69, 74, 76, 423.3, 424.8; 156/145, 293

[56] References Cited

U.S. PATENT DOCUMENTS

| | | | |
|---|---|---|---|
| 2,252,578 | 8/1941 | Powell . | |
| 2,263,070 | 11/1941 | Cusick | 52/743 |
| 2,551,751 | 5/1951 | MacDougall, Jr. | 52/745 |
| 2,779,066 | 1/1957 | Gaugler et al. | 428/69 |
| 2,817,124 | 12/1957 | Dybvig | 52/406 |
| 2,896,272 | 7/1959 | Latenser . | |
| 2,971,616 | 2/1961 | Bayley, Jr. . | |
| 3,264,165 | 8/1966 | Stickel . | |
| 3,854,253 | 12/1974 | Slowbe | 52/2 |
| 3,918,512 | 11/1975 | Kuneman | 160/90 |
| 4,100,309 | 7/1978 | Micklus et al. | 428/423.3 |
| 4,155,208 | 5/1979 | Shanabarger | 52/406 |
| 4,172,345 | 10/1979 | Alderman | 52/406 |
| 4,172,915 | 10/1979 | Sheptak et al. | 428/69 |
| 4,182,085 | 1/1980 | Elson | 52/2 |

FOREIGN PATENT DOCUMENTS 2708733 9/1977 Fed. Rep. of Germany .

*Primary Examiner*—Alfred C. Perham
*Attorney, Agent, or Firm*—Fay & Sharpe

[57] ABSTRACT

Bladder insulation which is adapted to be inserted within the wall cavities of existing buildings is disclosed which provides for high quality insulation having a high R value. The invention describes a bladder or impervious bag constructed of two thermoplastic sheets of material hermetically sealed at both ends and on each of the sides. The preferred film used herein is urethane although polyethylene of from 4 to 15 mils in thickness may be employed on the inside and/or the outside of the bladder. This bag can be inflated within the wall cavity and filled with various insulative materials and/or pressurized with various fluorinated hydrocarbon gases. The various insulative fill materials used may be, but to be all not inclusive, vermiculite, mineral wool, microballoons of either glass or plastic, and eggcrates, or any combinations of these materials. An expandable eggcrate device constructed of thermoplastic material in a collapsed state and sandwiched between two layers of thermoplastic material that expands into an eggcrate when inflated creates a semi-rigid plastic material. The gaseous medium used in this invention consists preferably of fluorinated hydrocarbon gas, $CO_2$ or $N_2$, and has a pressure of up to one and one-half pounds, or a vacuum of 16 to 18 inches of water, which is about 0.65 pounds vacuum, or about 0.05 atmospheres.

The invention also includes a means for inserting the bladder with the wall of a structure and rigidifying the bladder by adherence to studs or a polymerization technique to form a polyisocyanate on the interior side of the bladder.

7 Claims, 7 Drawing Figures

BLADDER INSULATION

BACKGROUND OF THE INVENTION

A number of bladder insulation techniques are known from the prior art references listed below:

U.S. Pat. No. 2,252,578 to Powell discloses a method of insulating buildings. A flexible bag is placed inside a wall in a collapsed state. Thereafter insulation is poured into the bag to fill the space between the inside and outside walls. The bag is not inflated with air.

U.S. Pat. No. 3,918,512 to Kuneman discloses a window sealing arrangement wherein an inflatable bag is placed between the inside and outside windows in a storm window arrangement and then inflated. An insulating air space is thus provided.

U.S. Pat. No. 4,155,208 to Shanabarger provides for a sealed air space between studs in a building wall. FIG. 4 of that patent illustrates the insulating roll which is made up of a plurality of elongated elastic bags having air trapped inside.

U.S. Pat. No. 4,182,085 to Elson features an inflatable envelope of gas impervious material which is inserted in a building wall and inflated. It contains heat insulating material within the envelope.

German Pat. No. 27 08 733 discloses a method of attic insulation whereby a multicelled roll of plastic is rolled out in the attic, inflated with compressed air and filled with blown-in insulation.

Other U.S. Pat. Nos. of interest to this development include the following: 4,172,915, 2,971,616, 3,264,165, 4,172,345, 2,896,272, 4,182,085, 3,854,253.

SUMMARY OF THE INVENTION

This invention relates to an improved insulation material for existing structures and consists of polyurethane and other common insulation materials which may be employed therein.

An impervious layer of polyurethane, polyethylene or polypropylene from 4–15 mils in thickness is utilized on the inside of the wall, and a layer of film of the same material is utilized on the exterior side of the wall.

The bladder is filled with an insulating material and a slight pressure consisting primarily of fluorinated hydrocarbon gas, carbon dioxide or nitrogen.

A vacuum is used when the bladder is fixed within the studs by means of adhesive or by rigidifying the bladder by means of a polyisocyanate process.

BRIEF DESCRIPTION OF THE DRAWINGS

The invention may take physical form in certain parts and arrangements of parts. The drawings herein are for the purpose of illustrating preferred and alternate embodiments of the invention. They are not to be construed as limiting the invention.

DESCRIPTION OF THE PREFERRED EMBODIMENTS

Figure 1:
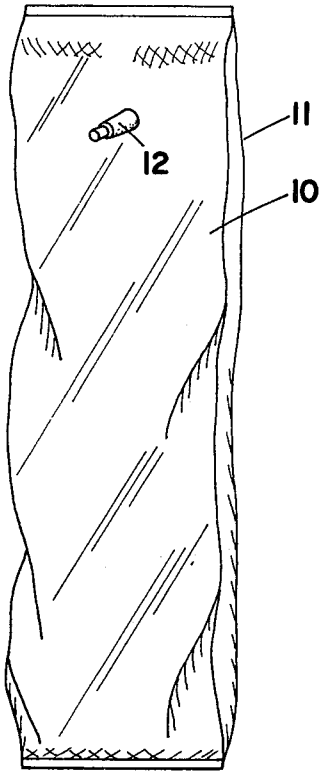
FIG. 1 is a schematic view illustrating bladder insulation.

This invention is directed to an improved insulation material for use in existing buildings, one example of which is shown in FIG. 1. In this view there is an impervious layer of polyurethane, polyethylene or polypropylene from 4–15 mils in thickness on the inside of the wall plus a layer of film of the same material on the outside of the wall. Of course, a material of substantially greater thickness may be used, but it would cost more and have reduced permeability as well as a tendency to puncturability whenever a nail or working tool is used.

Figure 3:
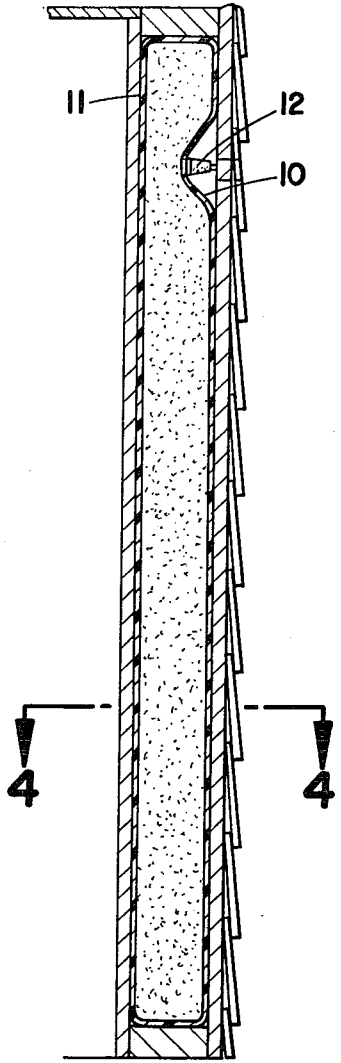
FIG. 3 is a cross-sectional view of a building wall showing the bladder insulation in place and filled.
Figure 2:
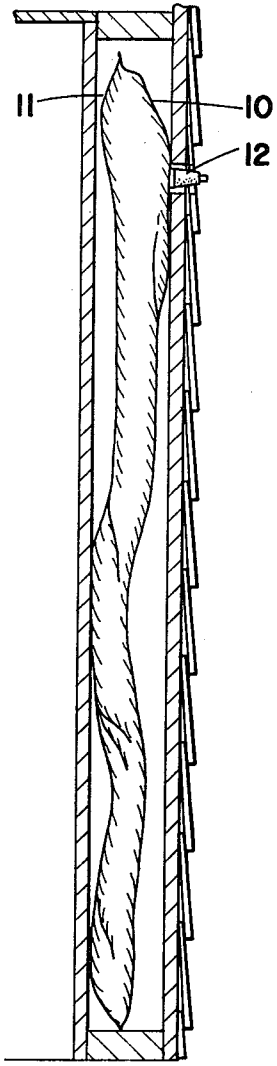
FIG. 2 is a side view of a section of a building illustrating the bladder in place.

FIG. 1 illustrates a section of bladder insulation with its outside at 10 and inside at 11 and a bladder valve at 12. The bladder is rolled up or assembled in a known manner and inserted through an opening in the wall and positioned therein by inflation of the bladder, more particularly shown in connection with FIG. 2. Various materials are then used as fillers as shown in FIG. 3. These materials may be vermiculite, mineral wool, microballoons of either glass or plastic, perlite, or eggcrate structures of polyurethane or cardboard. It is important that the insulation used must be of good quality material and that a gaseous medium surround the insulation. Such a gaseous medium might consist of carbon dioxide, fluorinated hydrocarbon gas or nitrogen, with a pressure of about one and one-half pounds, although, in certain instances, a vacuum may be used of about 0.65 psi.

Figure 4:
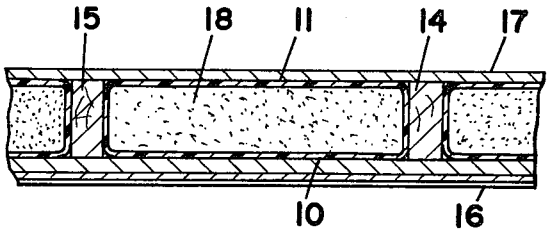
FIG. 4 is a cross-sectional view along the lines 4—4 of FIG. 3.

A section of the wall with the insulation between each of the studs is shown in connection with FIG. 4. One stud is shown at 14 and another at 15. Shingles or other outside materials are generally shown at 16, and the inside wallboard at 17. Between the studs is the bladder insulation, the inside of which is shown at 11 and the outside at 10. The insulation itself is shown at 19.

Figure 5:
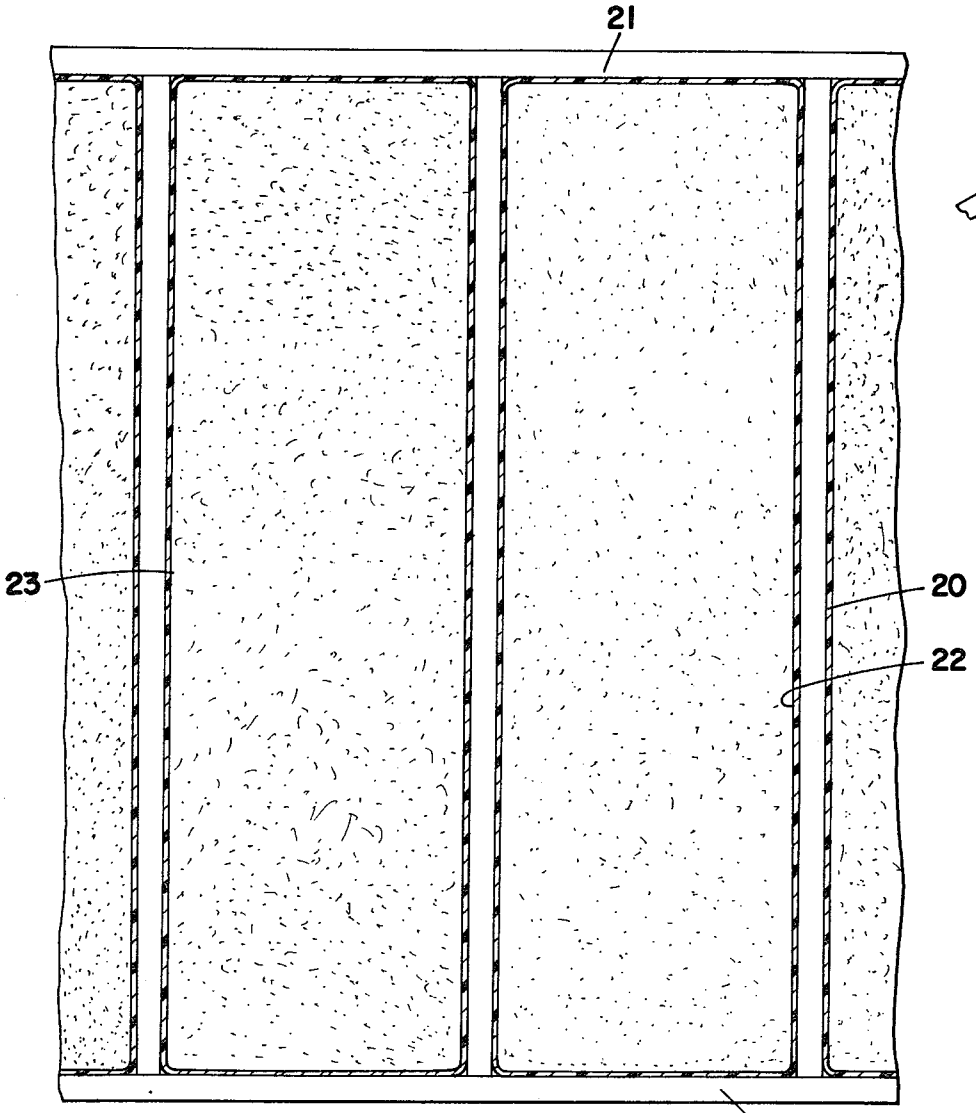
FIG. 5 is a longitudinal section showing a building wall with a number of bladder insulation members in cross section.

FIG. 5 illustrates another longitudinal cross section of a wall with three studs and two full panels as well as a portion of two other panels. Horizontal framing members are shown at 19. One of the vertical studs is shown at 20 and the top horizontal framing member at 21. One panel, which was described earlier, is featured at 22, while another panel is at 23.

Figure 6:
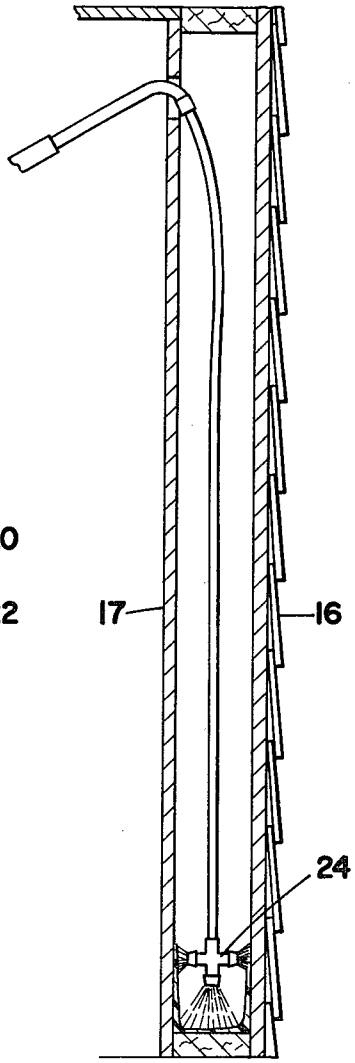
FIG. 6 illustrates a method of applying adhesive to the interior building wall.

Various methods are used to install panels, one method of which is shown in connection with FIG. 6. Here, a spray nozzle, which is generally indicated at 24, is positioned between the studs and between the outer and inner walls. For convenience, these are indicated as the outside shingles 16 and the wallboard 17. A spray nozzle 24 sprays adhesive in a controlled manner to the end of the stud and to the outside and inside by means of a directed nozzle which includes three openings therein. The nozzle is passed substantially along the full length of the space between the studs and adhesive is applied on the studs, on the outside wall and on the inside wall of the cavity. In like manner, the bladder insulation is inserted between the studs and inflated to press the bladder against the studs for securing it in position. After a time, when the adhesive has set, the bladder is ready for filling with a fill material. Either pressure or vacuum may be placed upon the bladder to complete the assembly for the bladder insulation.

Figure 7:
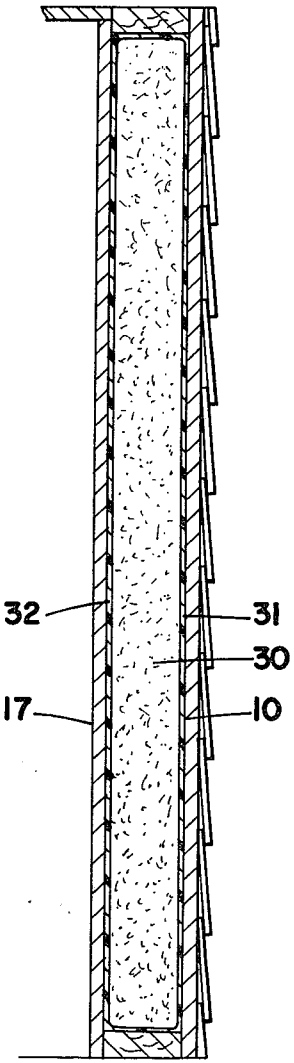
FIG. 7 illustrates a section of wall with the building insulation in place adhesively and filled with insulation.

FIG. 7 is a cross section of a portion of the same wall as illustrated in FIG. 6. The insulation is now in place and secured against the inside and outside walls. The insulation in this view is shown at 30 with the outside wall at 31 and the inside wall at 32.

In the first example of this invention an impervious film material is used consisting of polypropylene, polyurethane or polyethylene. A thickness for this material is chosen as 15 mils although it may be as low as 4 mils. The material is then inserted in the wall of a building through a suitable opening which is normally accomplished from the outside, after which it is filled with air, for example. Filler material for the bladder is then inserted in the wall, which may be vermiculite, mineral wool, microballoons of either glass or plastic, perlite or eggcrates and has already been assembled in the bladder prior to manufacture. Upon expansion with air or gas, the material stretches out and fills the space between the studs.

Following the insertion of the filler material, a gaseous medium is inserted to remove the air. This gaseous medium is preferably carbon dioxide, fluorinated hydrocarbon or dry nitrogen and has a pressure of about 1½ psi.

A further method of inserting and fastening the bladder insulation within the wall is by the use of an adhesive (see FIG. 6) which coats the space between the studs. The bladder is inserted between the walls, and a gaseous medium is employed along with insulation of the type previously disclosed. The adhesive sets and bonds the wall to the stud. Instead of just using pressure in the bladder, a vacuum may be utilized. A typical amount of vacuum is 16–18 inches of water, which is equivalent to about 0.65 psi, or 0.5 atmospheres vacuum.

In still another method, the bladder may be rigidified by extruding in a factory polyurethane materials that are partially cured, which are made generally by a reaction injection molding technique. The bladder is formed and filled on site with 4,4′ diphenylmethane diisocyanate gas to rigidify the inside layer of the bladder, and a small vacuum of the order described above is used to provide good quality insulation.

To aid in rigidifying the bladder, polyurethane eggcrates are placed within the bladder. As the film rigidifies the bladder, the eggcrates, which fill the spaces between the studs, are directed in position and secured to portions of the inside face of the insulation by means of the formed rigid polyurethane material made by the curing isocyanate gas.

For security, filler material is then placed in the bladder, i.e., vermiculite, mineral wool, microballoons or perlite, although vermiculite and mineral wool are the preferred materials. Microballoons may be used but are much more costly than the other materials. If the eggcrate structure is used, fill material is not necessary and therefore not employed. The vacuum in this instance is about 0.65 psi. It should be understood that if impervious films are strong and the attachment to the walls and rigidification of the film are adequate, higher vacuum is not required. When using vacuum, it is important not to use a material that would generate off-gas particularly during the aging process. Polyurethane is most desirable for this reason.

The invention has been described with reference to the preferred and alternate embodiments. Obviously, modifications and alterations will be readily apparent to others upon the reading and understanding of the specification. It is the intention to include all modifications and alterations insofar as they come within the scope of the appended claims or the equivalents thereof.

What is claimed is:

1. A method of making film bladder insulation in a completed structure consisting of:
   A. providing an opening between studs;
   B. spraying the studs with an adhesive before insertion of the film;
   C. securing a bladder of impervious film between the studs, said film being a member from the group consisting of polyurethane, polyethylene, and polypropylene from 4 to 15 mils in thickness;
   D. pressing the film against the studs by means of a gaseous medium to fasten the same and providing a means for rigidifying the bladder;
   E. filling said bladder with insulation from the group consisting of vermiculite, mineral wool, microballons of glass or plastic, perlite and eggcrates.

2. A method of making a bladder insulation in a completed structure consisting of:
   A. providing an opening between the studs;
   B. inserting a bladder between the studs which consists of polyurethane film from 4 to 15 mils in thickness, said film being only partially cured but remaining pliable; and
   C. filling said bladder with 4,4′ diphenylmethane diisocyanate gas to rigidify the film and exhausting said gas and filling the bladder with an inert gas from a member of the group consisting of fluorinated hydrocarbon gas, $CO_2$ and $N_2$ under pressure of about 1½ psi.

3. The method of claim 2 wherein the fill material is added from the group consisting of vermiculite, mineral wool, microballoons of glass and plastic and perlite.

4. The method of claim 2 wherein collapsible eggcrates are inserted in the bladder and lock upon filling of the bladder to aid in rigidifying said bladder.

5. A method of making bladder insulation in a completed structure consisting of:
   A. providing an opening between studs;
   B. inserting a bladder between the studs which consists of polyurethane film from 4 to 15 mils in thickness, said film being only partially cured but remaining pliable; and
   C. filling said bladder with isocyanate gas to rigidify the film and exhausting said gas and filling the bladder with an inert gas from a member of the group consisting of fluorinated hydrocarbon gas, $CO_2$ and $N_2$ under vacuum of about 0.65 psi.

6. The method of claim 5 wherein filler material is added from the group consisting of vermiculite, mineral wool, microballoons of glass or plastic and perlite.

7. The method of claim 5 wherein collapsible eggcrates are inserted in the bladder and lock upon filling of the bladder to aid in rigidifying said bladder.

* * * * *